US006148464A

United States Patent [19]

Shioda

[11] Patent Number: 6,148,464

[45] Date of Patent: Nov. 21, 2000

[54] GOLF BALL CLEANING DEVICE

[76] Inventor: Yoshihiko Shioda, 3416 Royal Crest Dr., Charlotte, N.C. 28210-3037

[21] Appl. No.: 09/243,965

[22] Filed: Feb. 3, 1999

[51] Int. Cl.[7] ..... A63B 47/04; A63B 57/00

[52] U.S. Cl. ..... 15/118; 15/210.1; 15/244.1; 15/104.93

[58] Field of Search ..... 15/118, 21.2, 210.1, 15/221, 244.1, 104.92, 104.94, 104.93

[56] References Cited

U.S. PATENT DOCUMENTS

| | | | |
|---|---|---|---|
| 1,710,816 | 4/1929 | Evans . | |
| 2,608,705 | 9/1952 | Duff . | |
| 2,624,900 | 1/1953 | Smith . | |
| 3,006,009 | 10/1961 | Hoffecker . | |
| 3,378,873 | 4/1968 | Strout . | |
| 3,453,675 | 7/1969 | Barton et al. | 15/104.92 |
| 3,462,230 | 8/1969 | Beard . | |
| 3,583,016 | 6/1971 | McConnell . | |
| 3,678,526 | 7/1972 | Burkholder . | |
| 3,750,219 | 8/1973 | MacConnell . | |
| 3,806,983 | 4/1974 | Cunningham et al. . | |
| 4,084,287 | 4/1978 | Ingram et al. . | |
| 4,103,388 | 8/1978 | DeVitis | 15/220.4 |
| 4,374,445 | 2/1983 | Wilson | 15/220.4 |
| 4,403,366 | 9/1983 | Lucke | 15/209.1 |
| 4,411,040 | 10/1983 | Sharrow et al. . | |
| 4,683,603 | 8/1987 | Purlia et al. | 15/210.1 |
| 4,974,763 | 12/1990 | Widrig . | |
| 5,075,918 | 12/1991 | Zeltner et al. | 15/210.1 |
| 5,641,232 | 6/1997 | Frey | 15/104.92 |
| 5,930,920 | 8/1999 | Arnold | 36/132 |

FOREIGN PATENT DOCUMENTS

| | | |
|---|---|---|
| 404322 | 1/1934 | United Kingdom . |

*Primary Examiner*—Mark Spisich
*Assistant Examiner*—Kaj K. Olsen
*Attorney, Agent, or Firm*—Kennedy Covington Lobdell & Hickman, L.L.P.

[57] ABSTRACT

An inexpensive, portable golf ball cleaning device which provides a readily accessible means for cleaning a golf ball at any time and at any point on the golf course. The golf ball cleaning device includes a ball cleaning pad removably attachable to a golfer at a position which is readily accessible and convenient for wiping a golf ball on the pad yet does not interfere with the golfer's swing. In the preferred embodiments, the golf ball cleaning pad is a water absorbent material retained at a lightweight, waterproof backing which extends outwardly and upwardly to form a curved bottom portion or storage space at the bottom end of the backing. In the second preferred embodiment, the backing includes side walls extending from the bottom portion to the top of the backing. In the third preferred embodiment, the backing includes side walls having a lip or front wall for removeably retaining the water absorbent material at the backing. In the fourth preferred embodiment, the device includes an absorbent cloth for wiping or drying the golf ball. In the preferred embodiments, a hook portion is provided for removably attaching the device to a golfer. The hook portion extends outwardly and downward from the top end of the backing and is adapted to hook onto a belt or waistband of a golfer. The hook portion extends across the entire width of the backing for securely anchoring the device in place. In addition, the attachment means may be a hook and loop-type adhesive material which is adapted to stick to the clothing of a golfer or a spring clamp or pin for releasably clasping onto the clothing of a golfer.

24 Claims, 13 Drawing Sheets

GOLF BALL CLEANING DEVICE

BACKGROUND OF THE INVENTION

The present invention relates generally to golf ball cleaning devices and, more particularly, to a portable golf ball cleaning device adapted for attachment to a golfer for providing a readily accessible and convenient means for cleaning a golf ball.

In playing golf, a golfer often must clean dirt, grass and other debris that is sticking to a golf ball from the ball so that the ball will be clean and not be affected when stroked by the dirt, grass or other debris. This is particularly significant before putting a ball on a green where irregularities on the ball can cause the ball to deviate from its path toward the hole. At such times, the mechanical ball washer at the tee box is not at hand and golfers must clean the ball manually. Some golfers carry damp towels for this purpose, others carry dry towels and moisten the spot on the ball by licking or spitting or rubbing it in damp grass. Others simply wipe the ball on their pants or shirt.

Therefore, there is a need for an inexpensive, lightweight, portable golf ball wiper which is readily carried by a golfer for wiping golf balls as needed or desired at any point on the course.

SUMMARY OF THE INVENTION

The present invention is directed to an inexpensive, portable golf ball cleaning device which provides a readily accessible means for cleaning a golf ball at any time and at any point on the golf course. The golf ball cleaning device of the present invention is lightweight and designed to be worn by a golfer for allowing the golfer to quickly and easily wipe off a golf ball as needed or desired by the golfer. The golf ball cleaning device includes a ball cleaning pad and a means for removably attaching the device to a golfer at a position which is readily accessible and convenient for wiping a golf ball on the pad yet does not interfere with the golfer's swing.

In the preferred embodiments, the ball cleaning pad is a water absorbent material which, when wetted, holds water and remains damp for an extended period of time, such as by way of example, a sponge material. The water absorbent material is mounted on a lightweight backing preferably constructed of a waterproof material, such as, by way of example, plastic sheet material or thin metal material or any other waterproof material. In the first preferred embodiment, the backing extends downward and curves outwardly and upwardly to form a curved bottom portion or storage space at the bottom of the backing for preventing excess water, which may drip off the wetted water absorbent sponge material, from dripping onto the golfer. In addition to preventing water from dripping onto the golfer, the storage space also retains a small amount of water therein and in contact with a portion of the water absorbent material extending into the curved portion so that the water absorbent material is kept damp longer by wicking for providing an effective damp surface for wiping off the golf ball. In a variation of the first preferred embodiment, the curved portion includes side retaining walls to better define a reservoir for holding water therein than the curved bottom portion without the side retaining walls and thus helping to keep the water absorbent material damp longer.

In a second preferred embodiment, the side retaining walls of the curved bottom portion of the first preferred embodiment extend upward from the curved portion to the top of the backing for preventing water from escaping off the sides of the water absorbent material and dripping onto the golfer. The side walls extend outward from the opposite sides of the backing and adjacent to the water absorbent material mounted on the backing. In use, the side walls form a barrier between the water absorbent material and the golfer to prevent water from dripping onto the golfer, in particular, when the golf ball is pressed against the front of the water absorbent material for cleaning the ball. In a third preferred embodiment, the side walls of the second preferred embodiment extend outward and then inward around the front of the water absorbent material to form a partial enclosure around the material and securing it therein. In this embodiment, the water absorbent material is removably positioned within the enclosure for easily removing and replacing the water absorbent material as desired. For example, the golfer may readily remove the water absorbent material in order to dampen it and may then easily reinsert the material into the enclosure for use. In addition, the water absorbent material may be readily removed and replaced with a new water absorbent material when the water absorbent material becomes soiled or is otherwise unsuitable for further use without having to replace the entire golf ball cleaning device.

In the preferred embodiments, the means for attaching the golf ball cleaning device to a golfer is a hook portion extending outwardly and downward from the top end of the backing. The hook portion is adapted to hook onto a belt or waistband of a golfer so that the cleaning device is conveniently carried at the waist of the golfer and ready for use by the golfer. In an alternative preferred embodiment, the means for attaching the cleaning device to a golfer is a hook and loop-type adhesive material, such as by way of example, Velcro®, adhered to the back of the backing. The Velcro® is adapted to stick to the clothing of the golfer and may be placed anywhere on the clothing at a position which is readily accessible for wiping a golf ball. The adhesive material may require that a compatible material first be attached to the golfer's clothing for mating with the adhesive material to attach the cleaning device to the golfer. Preferably, the cleaning device of the alternative embodiment will be positioned near the waist on the pants or shorts of the golfer. In another preferred embodiment, the means for attaching the golf ball cleaning device to a golfer is a spring clamp or clip attached to the back of the backing. The spring clamp is in a normally closed position and securely holds the device in place when clasped on the clothes of a golfer. While a hook, hook and loop type adhesive material and a spring clamp or clip are described herein, it will be understood that the attachment means may be any suitable element, such as, by way of example a pin, for attaching the golf ball cleaning device to a golfer's clothing or other readily accessible location, such as, by way of example, on a golf cart, for wiping a golf ball.

In a fourth preferred embodiment, the golf ball cleaning device of the present invention includes a section of absorbent cloth, such as, by way of example, a small towel, extending downward from the backing for wiping or drying the golf ball after it has been wiped on the water absorbent material, or anytime when the golf ball is damp and requires drying. The absorbent cloth of the fourth preferred embodiment is attached to the backing and is substantially the same width as the backing. The cloth may be attached with a hook and loop type fastener, such as, by way of example, Velcro®, or any other suitable means. In the fourth preferred embodiment, means for removably attaching the backing to a golfer is a narrow hook portion which extends outwardly from the top end of the backing and is adapted to hook the device onto a golfer's pocket. Alternatively, means for removably attaching the backing to a golfer is the spring clamp which securely holds the device on a pocket of a golfer's pants.

Therefore, it is an object and feature of the present invention to provide an inexpensive, lightweight, portable golf ball cleaning device which includes means for removably attaching the device to a golfer for providing a readily accessible and convenient device for cleaning a golf ball at any point on the golf course.

It is another object and feature of the present invention to provide a golf ball cleaning device including a water absorbent material which when wetted remains damp for an extended period of time.

It is an additional object and feature of the present invention to provide a golf ball cleaning device including a curved bottom portion or storage space for preventing water from dripping off the water absorbent material onto the golfer and for retaining water therein to help keep the water absorbent material damp longer.

It is yet another object and feature of the present invention to provide a golf ball cleaning device including side retaining walls for preventing water from dripping off the sides of the water absorbent material onto the golfer.

It is another object and feature of the present invention to provide a golf ball cleaning device including an enclosure for removably retaining the water absorbent material so that the golfer may readily remove and replace the water absorbent material of the cleaning device.

It is a further object and feature of the present invention to provide a golf ball cleaning device including a hook portion which removably attaches the device to a belt or waistband of a golfer.

It is yet another object and feature of the present invention to provide a golf ball cleaning device including a hook and loop adhesive material for removably attaching the device to the clothing of a golfer.

It is an additional object and feature of the present invention to provide a golf ball cleaning device including a spring clamp or clip for releasably securing the device to the clothing of a golfer.

It is a further object and feature of the present invention to provide a golf ball cleaning device including an absorbent cloth attached to the device for wiping or drying a damp golf ball.

Other objects and features will be readily apparent from the accompanying drawings and description.

DESCRIPTION OF THE PREFERRED EMBODIMENTS

Figure 1:
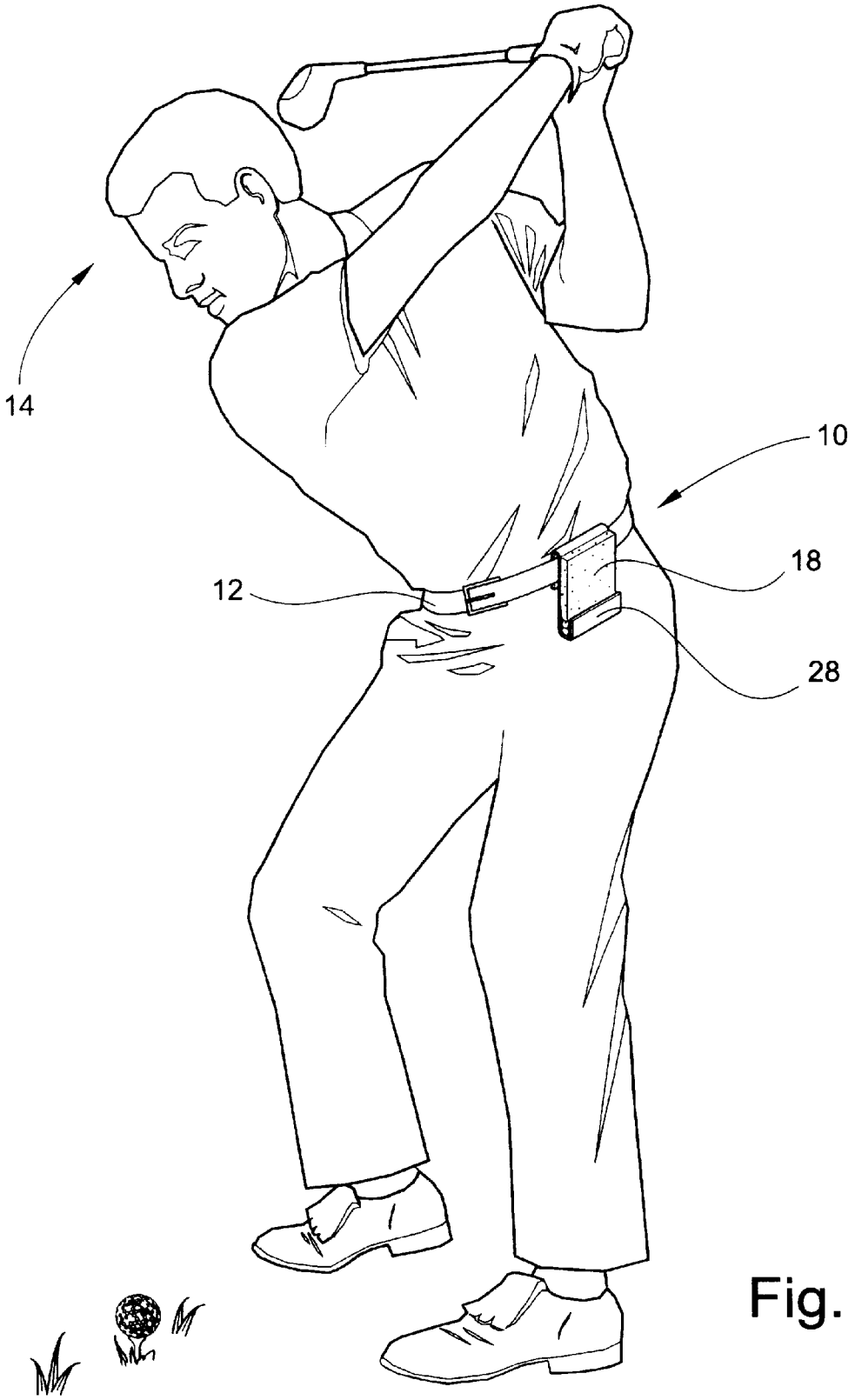
FIG. 1 is a perspective view of the golf ball cleaning device of the first preferred embodiment showing the device attached to the belt of a golfer.

Referring now to the accompanying drawings and initially to FIG. 1, the golf ball cleaning device of the present invention is designated generally by the reference numeral 10 and is adapted for attachment to a waistband or belt 12 of a golfer 14. The golf ball cleaning device 10 comprises a ball cleaning pad 18 and means for removably attaching the device 10 to a golfer 14 at a readily accessible and convenient position for the golfer to wipe a golf ball as needed or desired by the golfer.

Figure 2:
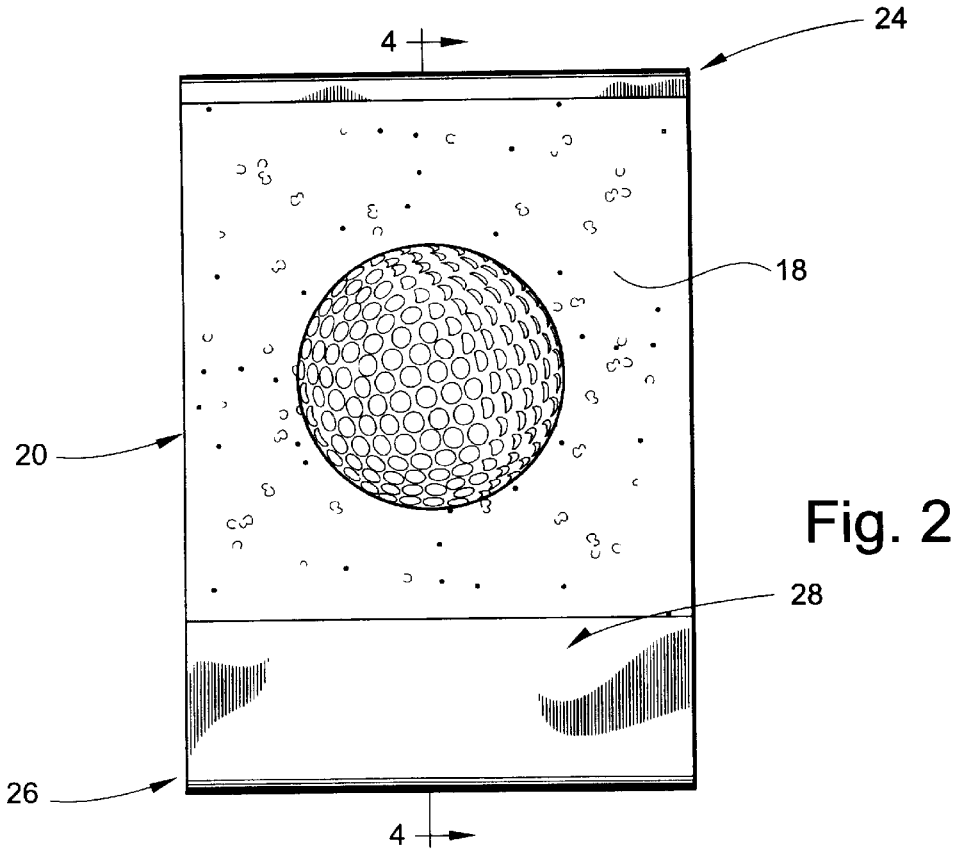
FIG. 2 is a front view of the golf ball cleaning device of FIG. 1 showing a golf ball being wiped on the sponge material.
Figure 3:
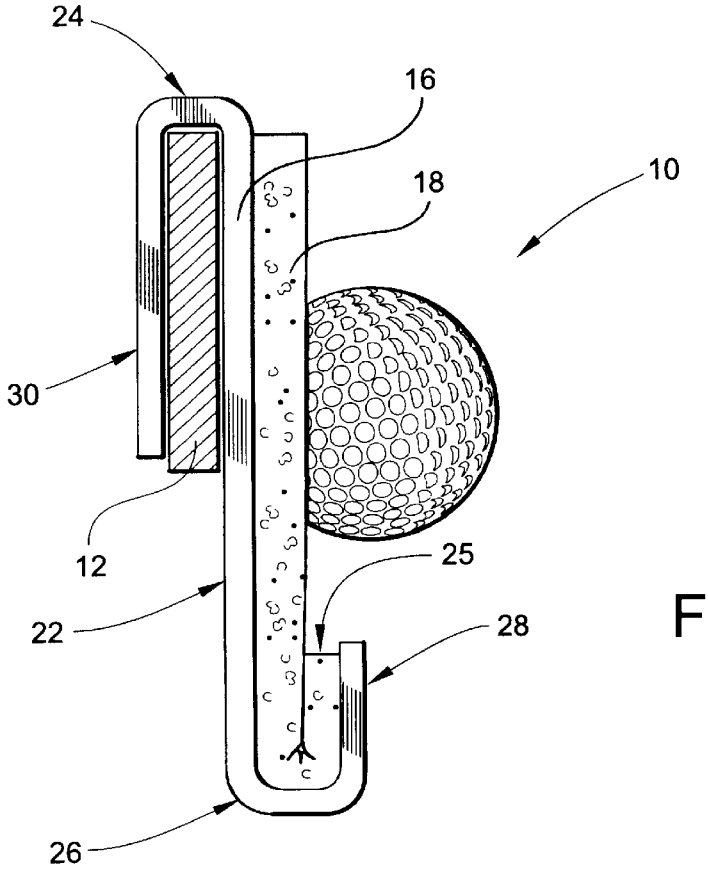
FIG. 3 is a side view of the golf ball cleaning device of FIG. 1 showing the curved portion at the bottom end of the backing and the hook portion at the top end of the backing extending over a belt and showing a golf ball being wiped on the sponge material.
Figure 4:
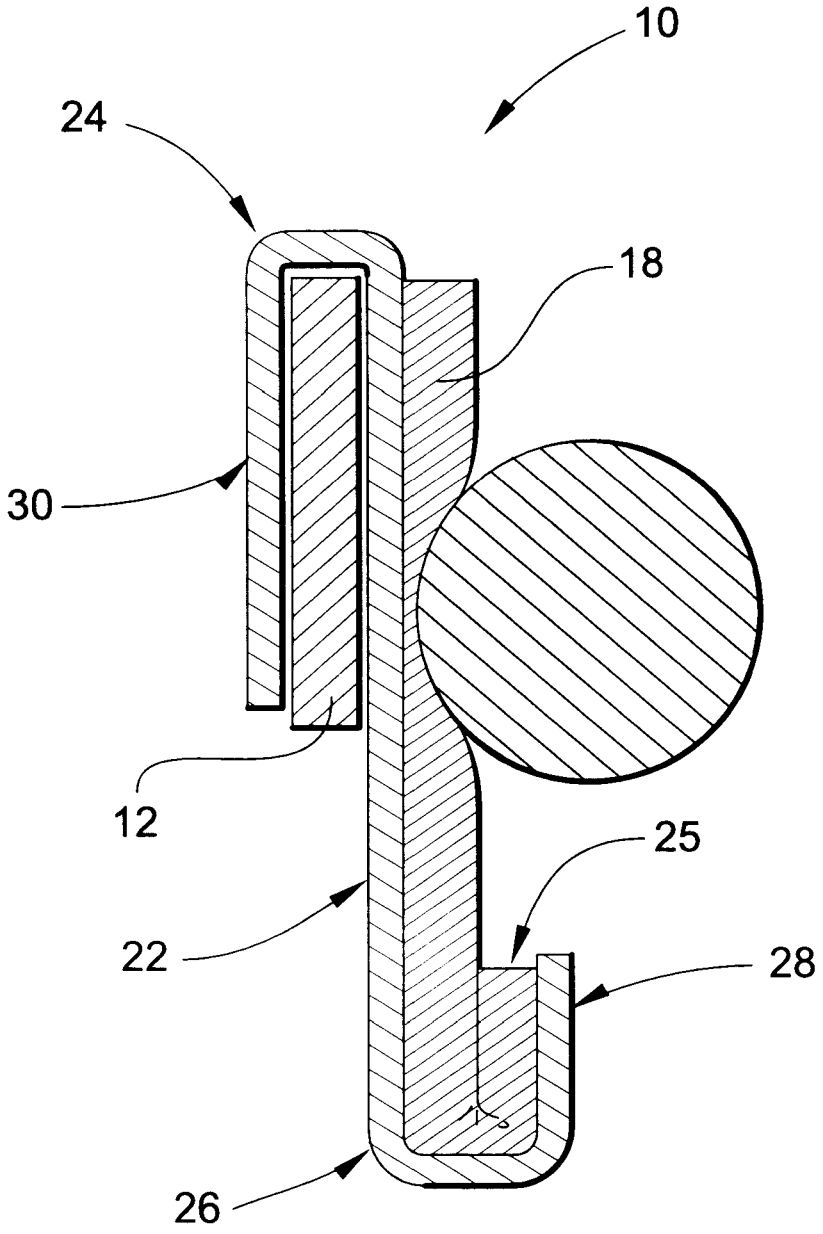
FIG. 4 is a cross-sectional taken along line 4—4 in FIG. 3.
Figure 5:
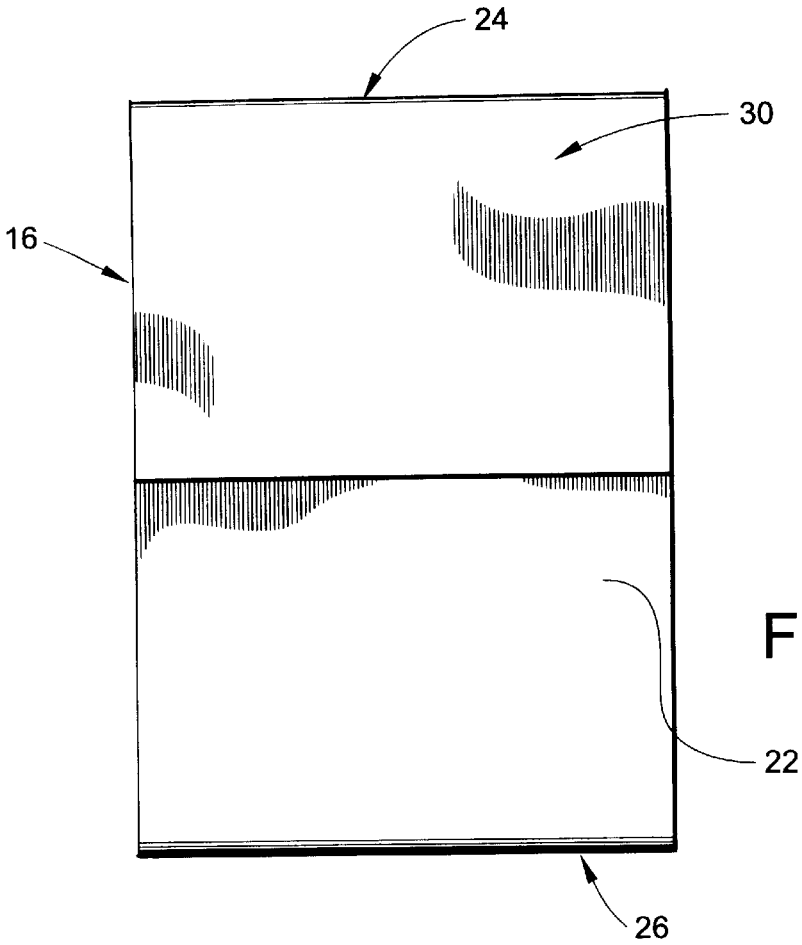
FIG. 5 is a rear view of the golf ball cleaning device of FIG. 1 showing the backing with the hook portion extending across the width of the backing.
Figure 6:
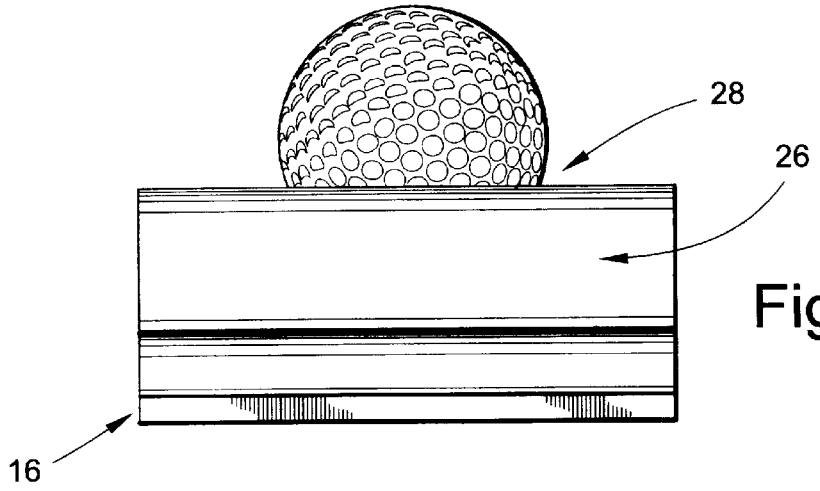
FIG. 6 is a bottom view of the golf ball cleaning device of FIG. 1 showing the bottom of the curved portion.
Figure 7:
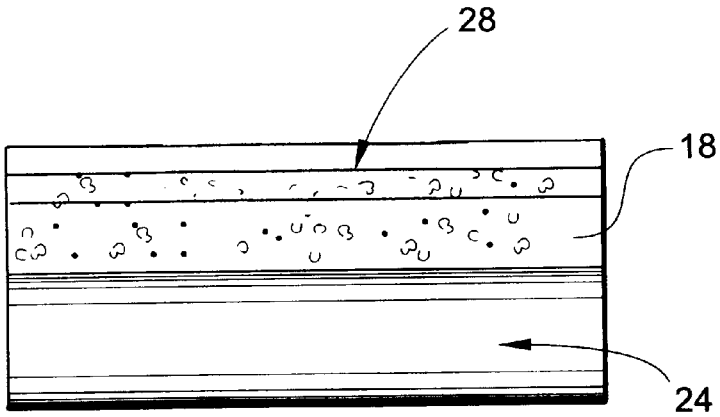
FIG. 7 is a top view of the golf ball cleaning device of FIG. 1 showing the sponge material and a golf ball being wiped thereon.
Figure 10:
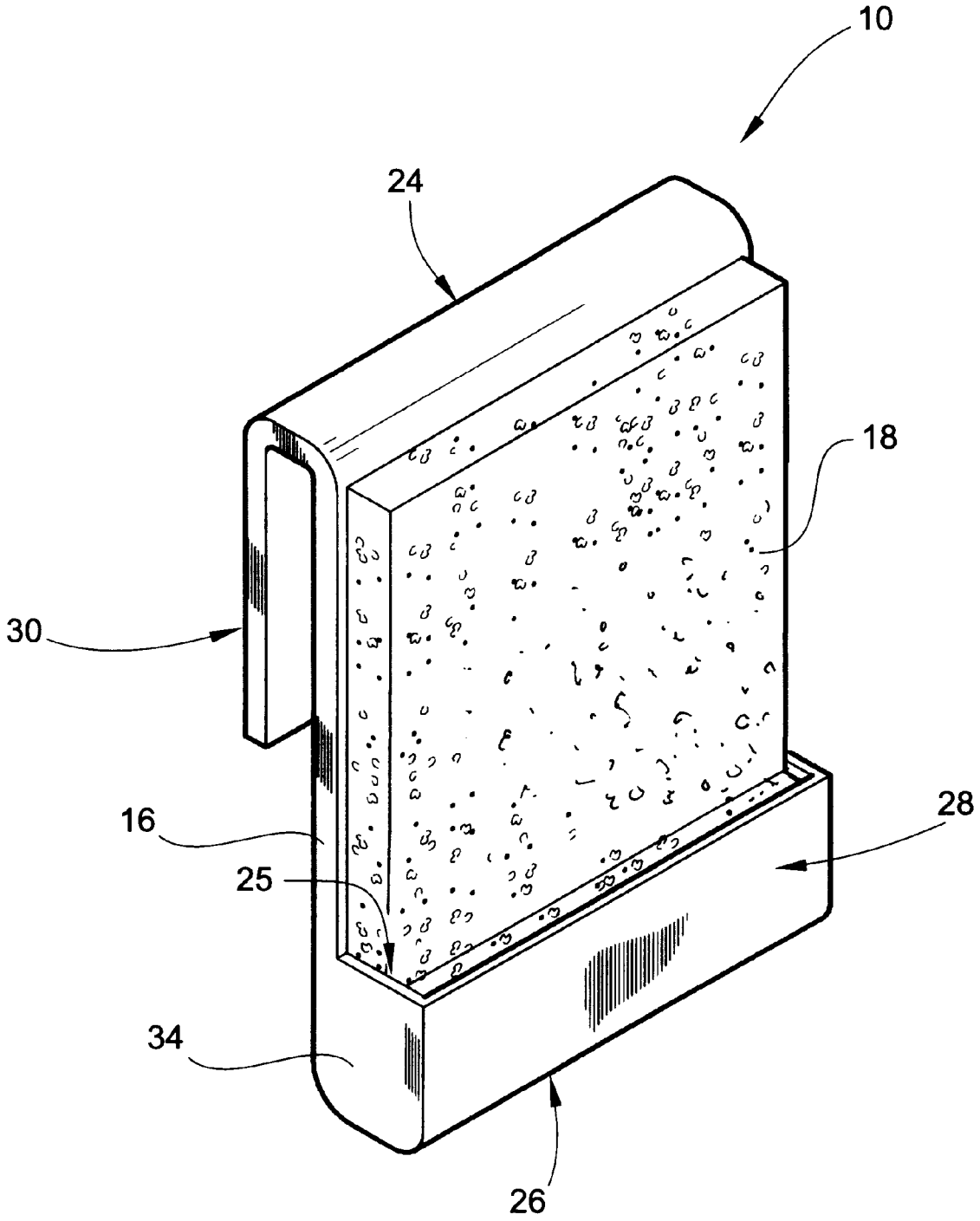
FIG. 10 is a perspective view of a variation of the first preferred embodiment of the device including side walls on opposite ends of the bottom portion.

In the first preferred embodiment illustrated in FIGS. 1–7, the golf ball cleaning device 10 includes a waterproof holder or backing 16 constructed of a plastic sheet material, such as solid polyethylene, or a thin metal material or any other suitable material which is waterproof and lightweight and can support a ball cleaning pad. The backing 16 includes a front side 20, a back side 22, a top end 24 and a bottom end 26. While the pad may be any water absorbent material which, when wetted, holds water and remains damp for at least some period of time, the preferred ball cleaning pad 18 is a sponge material, such as resilient foam plastic, which is retained at the front side 20 of the backing 16. In the preferred embodiment, the sponge material 18 is mounted by any suitable conventional adhesive on the front side 20 of the backing 16 as shown in FIG. 2. As best seen in FIG. 3, the bottom end 26 extends outwardly and upwardly from the front side 20 to form a bottom portion 28 and the sponge material 18 extends into the bottom portion 28. In the preferred embodiment, the bottom portion 28 is curved. As shown in FIGS. 6 and 7, the curved bottom portion 28 extends outward from the front side 20 of the backing beyond the sponge material 18 to define a storage space 25 for the sponge material 18 and excess water. In addition, as shown in FIG. 10, the curved bottom portion 28 may include a pair of side walls 34 for better defining the storage space 25 and providing a reservoir for holding water therein.

Figure 11:
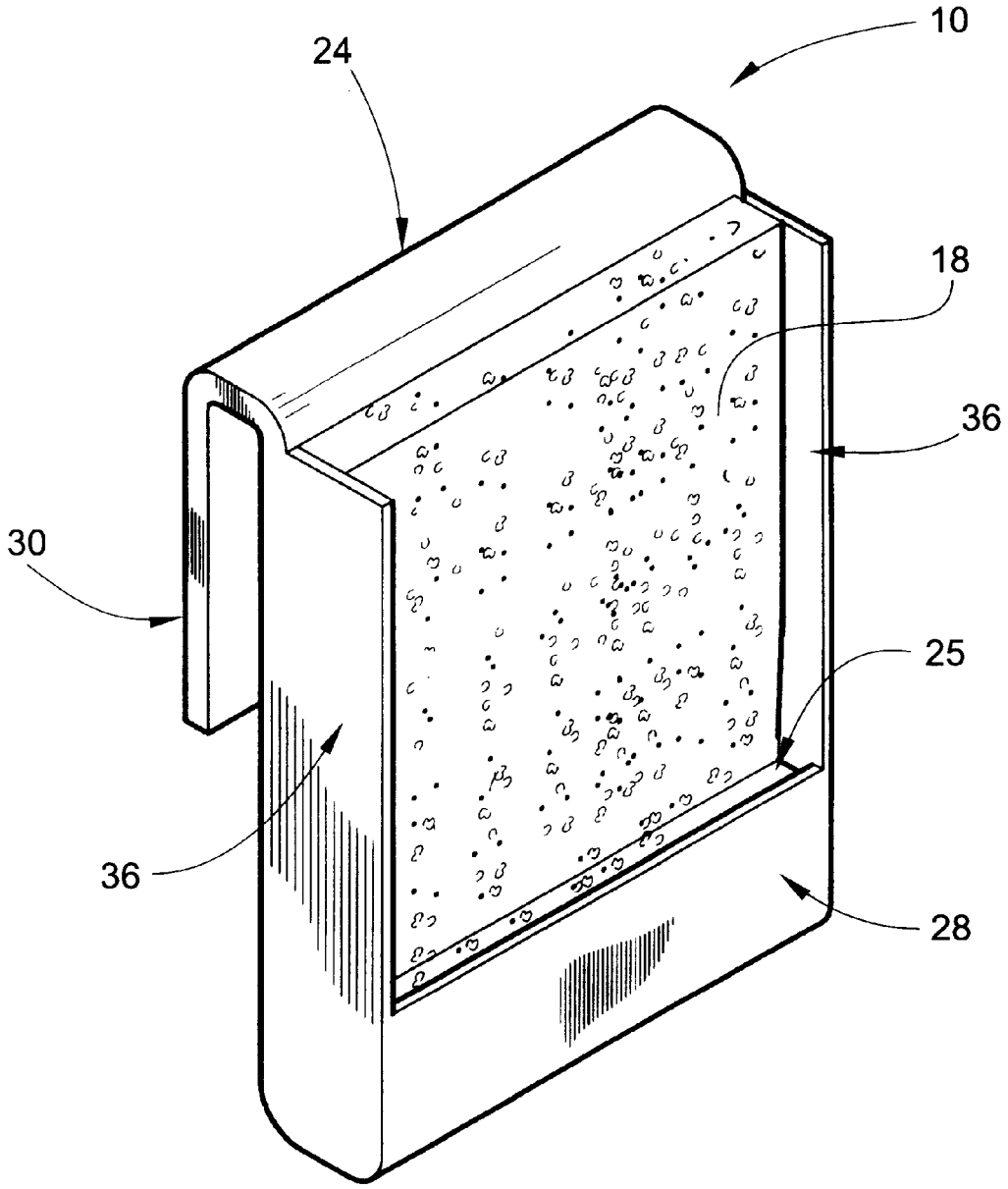
FIG. 11 is a perspective view of a second preferred embodiment of the device including side walls on opposite ends of the bottom portion which extend upward to the top of the backing.

In a second preferred embodiment illustrated in FIG. 11, the golf ball cleaning device 10 of the first preferred embodiment includes a pair of side walls 36 which extend across opposite ends of the curved portion 28 and upward to the top end 24 of the backing 16 for better defining the storage space 25 and providing a barrier between the sponge material 18 and the golfer. In use, the side walls 36 extend outward from opposite ends of the front side 20 of the backing 16 adjacent to the sides of the sponge material 18 to prevent water from dripping onto the golfer, in particular, when the golf ball is pressed against the sponge material 18 for cleaning the ball.

Figure 12:
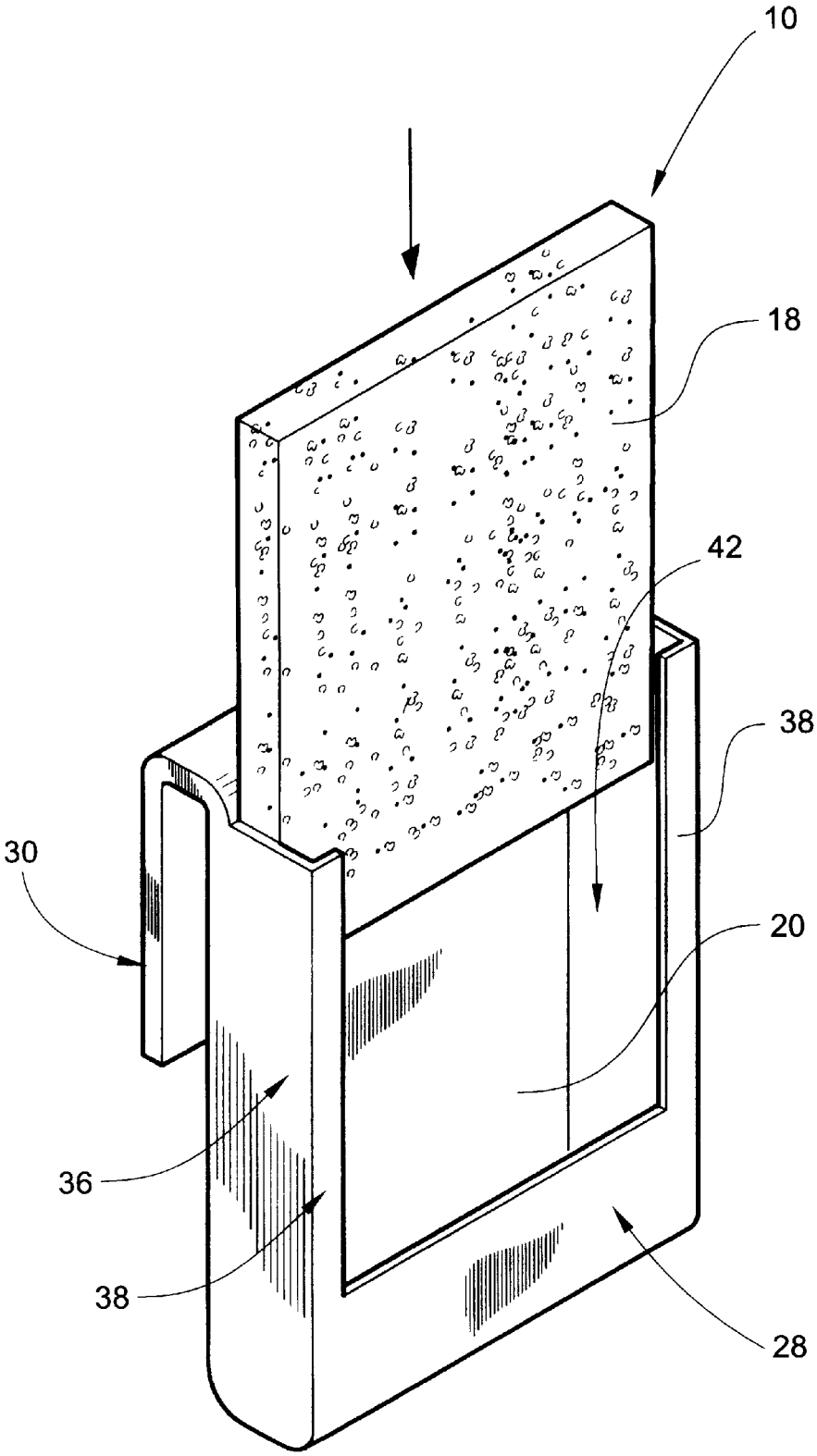
FIG. 12 is a perspective view of a third preferred embodiment of the device including side walls on opposite ends of the bottom portion which extend upward to the top of the backing and inward toward the front of the backing to form a partial enclosure around the water absorbent material which is removably placed therein.

FIG. 12 illustrates a third preferred embodiment of the present invention. In the third preferred embodiment, the golf ball cleaning device of the second preferred embodiment further includes a pair of lips or front walls 38 extending inward from the side walls 36 to form a partial enclosure 42 for retaining the sponge material 18 at the front side 20 of the backing 16. As can be seen in FIG. 12, the front walls 38 extend only partially across the front side 20 of the backing and provide a wide opening 40 so that sponge material 18 held within the enclosure 42 remains readily accessible for wiping the golf ball thereon. As shown in FIG. 12, the sponge material 18 of the third preferred embodiment is retained by the front walls 38 and is not adhered to the front side 20 of the backing 16 so that it may be readily removed from and replaced within the enclosure 42. Thus, the golfer may readily remove the sponge material 18 for dampening it or replacing it, as desired.

The preferred embodiments of the golf ball cleaning device of the present invention include means for removably attaching the backing 16 to a golfer in a position in which the device 10 is readily accessible and conveniently used by the golfer. In the first preferred embodiment, the attachment means is a hook portion 30 which extends outwardly from the back side 22 of the backing 16 and downward from the top end 24. While the hook portion 30 is adopted to hook the device 10 onto a golfer's belt or waistband and is preferably worn by the golfer using the device 10, the hook portion 30 may be secured almost anywhere which includes a location suitable for receiving a hook and is desired by the golfer, such as, by way of example, a golf bag or golf cart. As shown in FIG. 3, the hook portion 30 extends from and is integral with the backing 16 and is preferably constructed of the same thin metal or sturdy plastic material to keep the cost of manufacturing the device low. However, it will be understood that the hook portion 30 may be separate and/or may be constructed of any other suitable material, such as, by way of example, a flexible plastic or rubber material which may be comfortably worn on the golfer's belt or waistband. As shown in FIG. 5, the hook portion 30 extends across the entire width of the backing 16 for securely anchoring the device 10 in place and preventing the device from swinging or tilting from side to side when in use or while the golfer is swinging or walking. As shown in FIGS. 11 and 12, the attachment means of the second and third preferred embodiments of the present invention is also preferably the hook portion 30.

Figure 8:
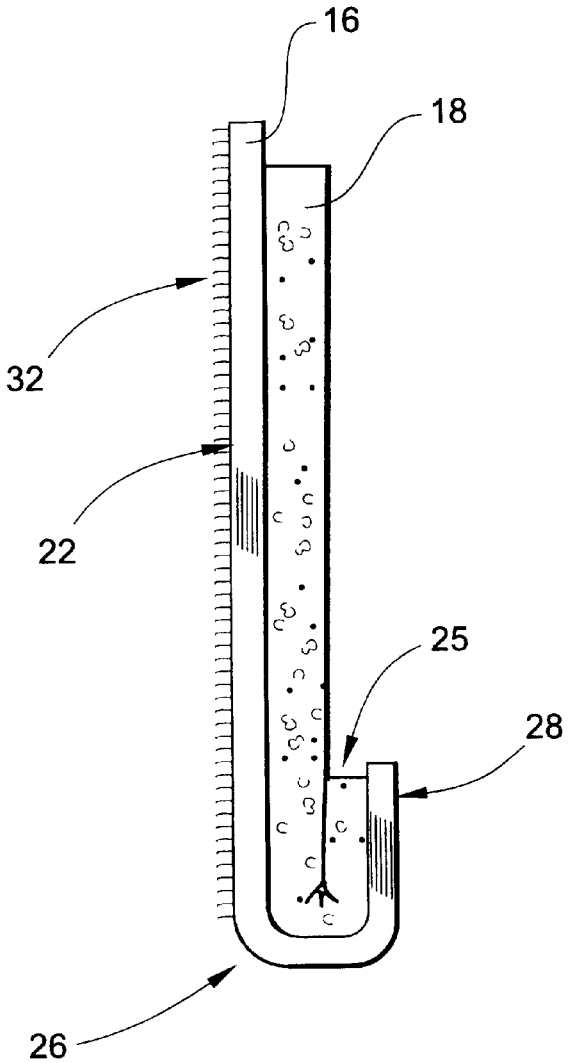
FIG. 8 is a side view of the first preferred embodiment of the golf ball cleaning device showing the curved portion at the bottom end of the backing and an adhesive material on the back of the backing and showing a golf ball being wiped on the sponge material.
Figure 9:
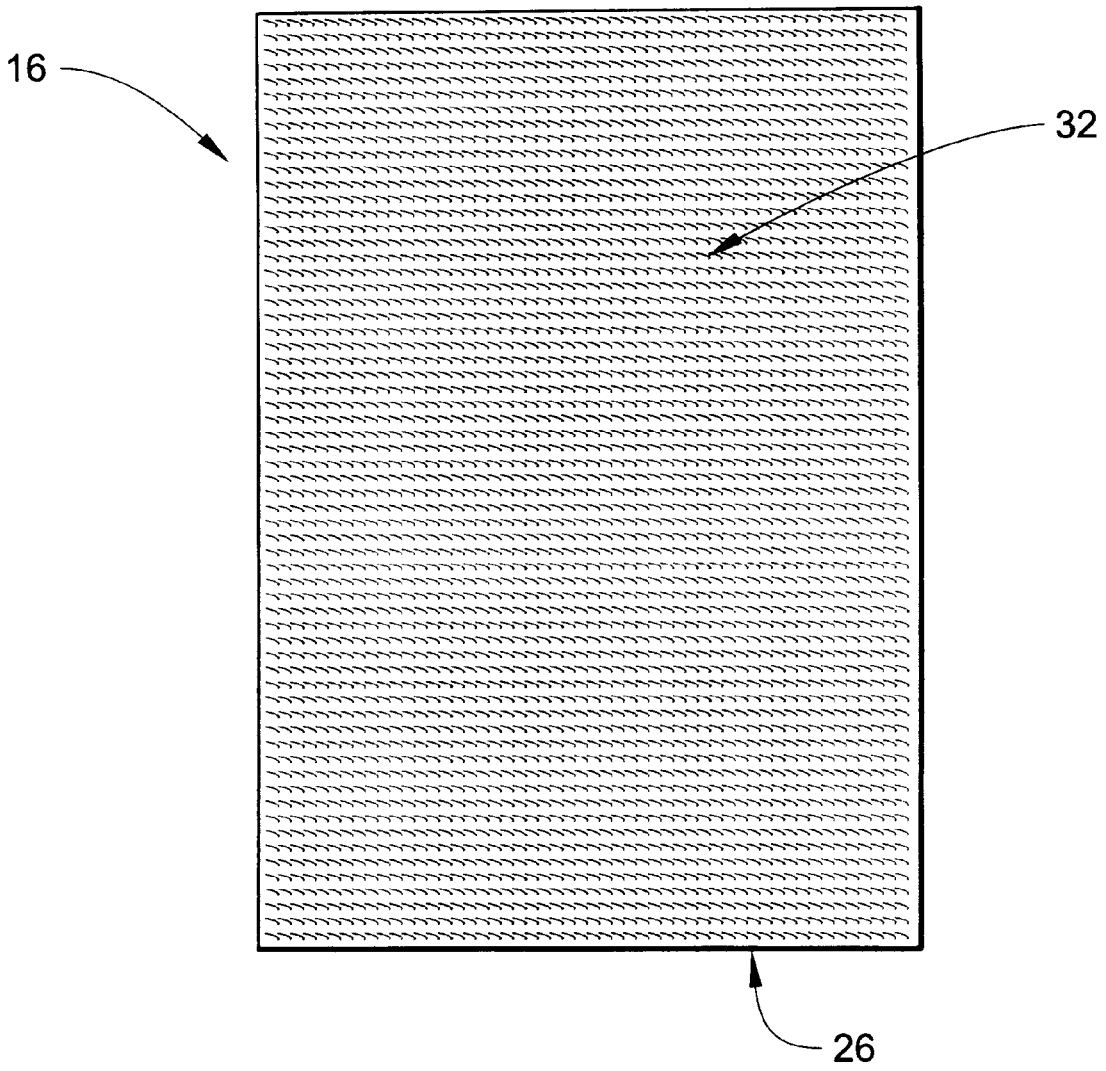
FIG. 9 is a rear view of the golf ball cleaning device of FIG. 8 showing the adhesive material extending along the entire back of the backing.

FIGS. 8 and 9 illustrate an alternative embodiment of the first preferred embodiment of the present invention. In the alternative embodiment, the means for removably attaching the golf ball cleaning device 10 to a golfer is an adhesive material or fastener on the back side 22 of the backing 16. In the alternative first preferred embodiment, the adhesive material is a hook and loop-type fastener 32, such as, by way of example, Velcro®, which is adhered to the backing 16. As shown in FIG. 9, the fastener 32 covers the entire back side 22 of the backing 16 for securely attaching the device 10 to a golfer's clothing or garment. It will be understood that a compatible material, such as a strip including a compatible hook and loop-type fastener, for receiving the hook and loop-type fastener 32 may be adhered to the golfer's clothing for securely attaching the device to the golfer. In addition, the means for removably attaching the golf ball cleaning device to a golfer may alternatively be a pin, such as, by way of example, a safety pin, or any other suitable attachment means.

Figure 13:
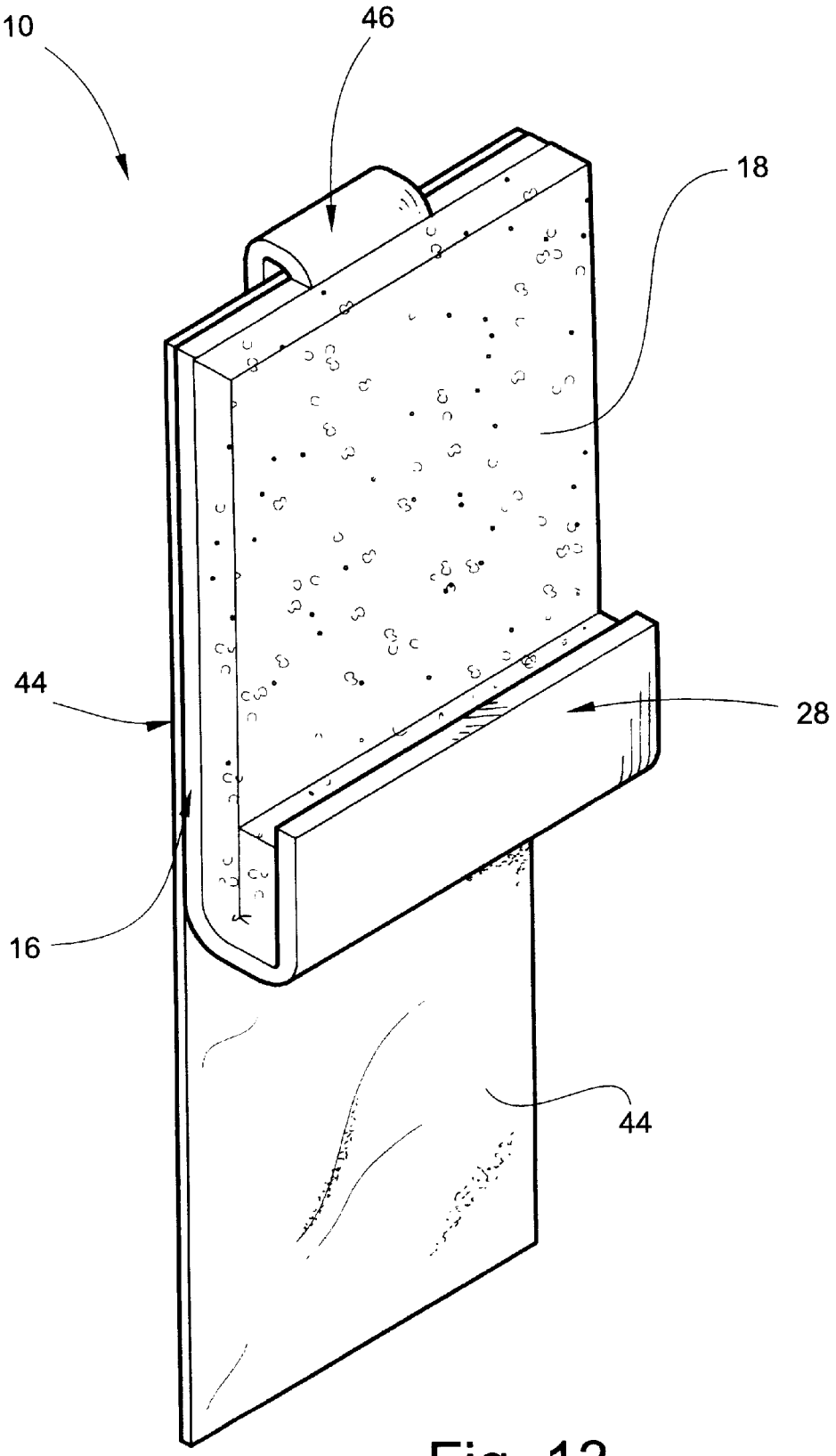
FIG. 13 is a perspective view of a fourth preferred embodiment of the device including a piece of absorbent material attached to the device for wiping a golf ball thereon.
Figure 14:
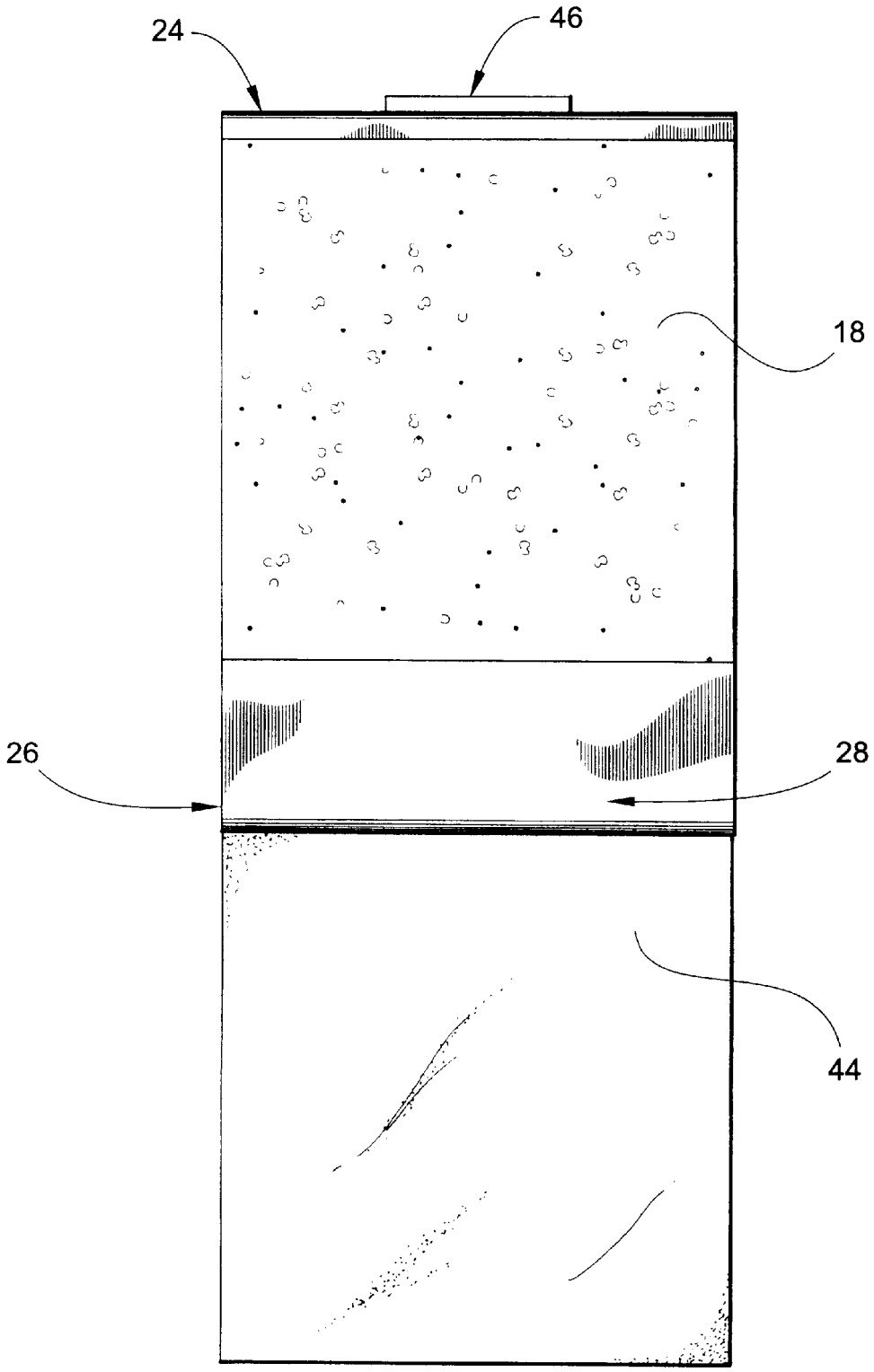
FIG. 14 is a front view of the fourth preferred embodiment of the device shown in FIG. 13.
Figure 15:
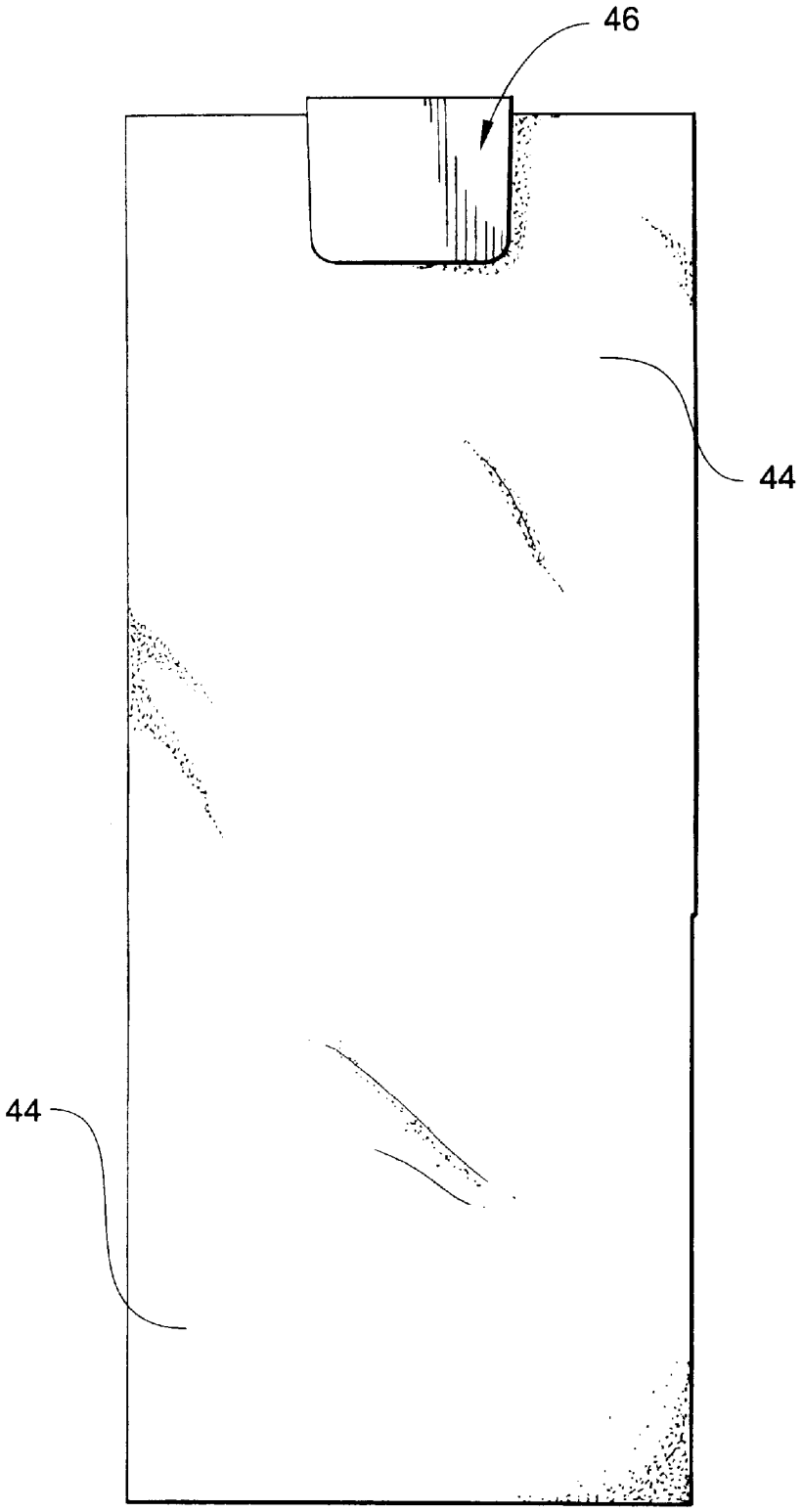
FIG. 15 is a rear view of the device shown in FIG. 14 showing the narrow hook portion for attaching the device to a golfer's pocket.

A fourth preferred embodiment is illustrated in FIGS. 13–15. In this embodiment, the golf ball cleaning device of the present invention includes a section of absorbent cloth 44, such as, by way of example, a small towel, extending downward from the backing 16 for wiping or drying the golf ball after it has been wiped on the sponge material 18 or anytime when the golf ball requires drying. While the golf ball cleaning device shown includes the features of the first preferred embodiment, it will be understood that the golf ball cleaning device of the fourth preferred embodiment may include the side walls 34 or side walls 36 and/or front walls 38 of the second and third embodiments of the present invention. As shown in FIG. 13, the absorbent cloth 44 is substantially the same width as the backing 16 and extends beyond the bottom end 26 of the backing 16 for a distance which is approximately the same length as the backing 16. The absorbent cloth 44 may be attached to the backing 16 with a hook and loop type fastener, such as, by way of example, Velcro®, where one portion is added to the back side 22 of the backing 16 and a mating portion is added to the absorbent cloth 44. While Velcro® is identified as one suitable method for attaching the absorbent cloth 44 to the backing 16, the absorbent cloth 44 can be attached by any other suitable means and is readily available for use in connection with the use of the golf ball cleaning device 10. In the fourth preferred embodiment, the absorbent cloth 44 extends from the top end 24 of the back side 22 of the backing 16 to the bottom end 26 and for a distance beyond the bottom end 26. Thus, in addition to providing an absorbent surface on which a ball may be wiped, the absorbent cloth 44 provides an additional barrier between the damp sponge material 18 and the golfer for further preventing water from dripping on the golfer during the use of the device.

In the fourth preferred embodiment, means for removably attaching the backing 16 to a golfer in a position in which the device 10 is readily accessible and conveniently used by the golfer is a hook portion 46 which extends outwardly from the back side 22 of the backing 16 and downward from the top end 24. In the fourth preferred embodiment, the hook portion 46 is adapted to hook the device 10 onto a golfer's pocket and is preferably worn by the golfer using the device 10. The hook portion 46 may be secured almost anywhere which includes a location suitable for receiving a hook and is desired by the golfer, such as, by way of example, a golf bag or golf cart. As shown in FIGS. 13 and 15, the hook portion 46 extends from and is integral with the backing 16 and is narrow to slide into and hook onto a golfer's pocket.

The hook portion 46 is preferably constructed of the same thin metal or sturdy plastic material to keep the cost of manufacturing the device low. However, it will be understood that the hook portion 46 may be separate and/or may be constructed of any other suitable material, such as, by way of example, a flexible plastic or rubber material which may be comfortably worn on the golfer's pocket, belt or waistband.

Figure 16:
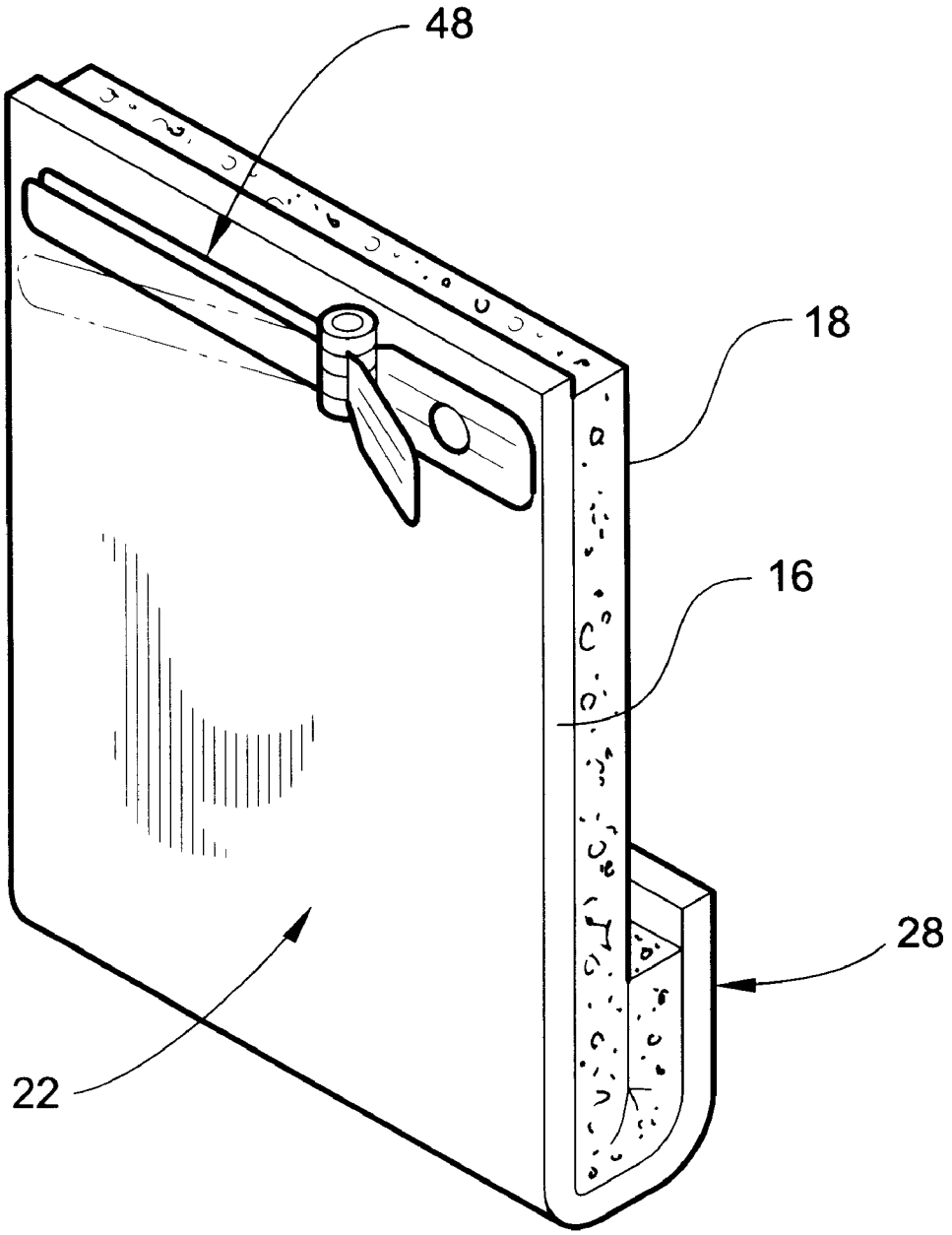
FIG. 16 is a perspective view of the first preferred embodiment of the device including a spring clamp for attaching the device to the golfer.

FIG. 16 illustrates an alternative embodiment of the attachment means of the preferred embodiments of the present invention. In the alternative embodiment, the means for removably or releaseably attaching the golf ball cleaning device 10 to a golfer is a clipping device or spring clamp 48, such as, by way of example, a spring-loaded scissor clip, on the back side 22 of the backing 16. As shown in FIG. 16, the spring clamp 48 is moveable between a normally closed position to an open position for clasping the clamp 48 onto a portion of a golfer's clothing or garment and securely attaching the device 10 thereto. While the spring clamp 48 may be used to removably secure the device to the golfer's belt, waistband or on a location on the cart, the spring clamp 48 is preferably inserted and clasped onto a golfer's pocket and used to secure the device 10 on the pocket of a golfer's pants. The spring clamp 48 may be used with any of the preferred embodiments of the present invention and is particularly suitable for use with the golf ball cleaning device of the fourth preferred embodiment which includes the absorbent cloth and is preferably attached to a golfer's pocket.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention.

The foregoing disclosure is not intended or to be construed to limit the present invention or otherwise to exclude any such other embodiments, adaptations, variations, modifications and equivalent arrangements.

What is claimed is:

1. A portable device for cleaning a golf ball comprising:

a. a waterproof backing having a front side, a back side, a top end and a bottom end, said bottom end extending outwardly and upwardly from said front side to form a bottom portion;

b. a water absorbent material retained at said front side of said backing, exposed outwardly therefrom, and extending into said bottom portion;

c. means for removably attaching said backing to the exterior of a golfer's garment at a location which is readily accessible and convenient for wiping a golf ball on said water absorbent material;

d. wherein said water absorbent material may be wetted with said bottom portion retaining water therein for preventing water from dripping onto a golfer and keeping said water absorbent material damp; and e. a water absorbent cloth attached to said backing and extending below said bottom portion for wiping or drying a golf ball thereon.

2. The portable device of claim 1, wherein the means for removably attaching said backing to the garment of a golfer comprises a hook portion extending outwardly and downwardly from said top end of said back side.

3. The portable device of claim 2, wherein said hook portion extends across the width of said back side of said backing.

4. The portable device of claim 1, wherein said means for removably attaching said backing to the garment of a golfer comprises a hook and loop-type fastening means having a first portion adhered to the garment of the golfer and a second complimentary portion adhered to said back side and retainingly engageable with said first portion.

5. The portable device of claim 1, wherein said means for removably attaching said backing to a golfer comprises a spring clamp attached to said backing for releasably clasping onto the garment of the golfer.

6. The portable device of claim 1, wherein said bottom portion defines a storage space for storing water.

7. The portable device of claim 6, wherein said water absorbent material is doubled on itself in said bottom portion.

8. The portable device of claim 6, wherein said storage space further includes a pair of side walls on opposite ends of said bottom portion for holding water within said storage space.

9. The portable device of claim 8, wherein said side walls extend upward from said opposite ends of said bottom portion to said top end of the backing for preventing water from dripping onto a golfer.

10. The portable device of claim 9, wherein each of said side walls further includes a wall portion extending inward partially over the water absorbent material for retaining said water absorbent material at the front side of the backing.

11. The portable device of claim 10, wherein said water absorbent material is removably positioned at said front side of the backing and removably retained thereat by said front walls.

12. The portable device of claim 11, wherein said enclosure includes an opening for providing ready access to said water absorbent material held therein.

13. The portable device of claim 9, wherein said side and front walls form an enclosure for removably retaining said water absorbent material at the front side of the backing.

14. The portable device of claim 1, wherein said water absorbent material is adhered to said front side of said backing.

15. The portable device of claim 1, wherein said backing is a lightweight plastic.

16. The portable device of claim 1, wherein said water absorbent cloth is attached to said back side of said backing and is substantially the same width as said back side of said backing.

17. The portable device of claim 16, wherein said water absorbent cloth extends from said top end of said back side to said bottom end and extending below said bottom portion to provide a barrier to prevent water escaping from the device onto the garment of a wearer.

18. The portable device of claim 1, wherein the means for removably attaching said backing to a golfer comprises a hook portion extending outwardly and downwardly from said top end of said back side, said hook portion being adapted to be inserted in a pocket of a golfer's garment with the exposed water absorbent material being exterior of the garment.

19. The portable device of claim 1, wherein the means for removably attaching said backing to a golfer comprises a spring clamp attached to said back side of said backing for releasably clasping onto the garment of a wearer.

20. The portable device of claim 1, wherein said water absorbent material is a water absorbent sponge material.

21. A portable device for cleaning a golf ball comprising:

a. a waterproof backing having a front side, a back side, a top end and a bottom end, said bottom end extending outwardly and upwardly from said front side to form a bottom portion;

b. a water absorbent material attached to said front side of said backing, exposed outwardly therefrom, and extending into said bottom portion, said bottom portion including a pair of side walls on opposite ends of said bottom portion, said side walls extending upward to said top end of said backing;

c. means for removably attaching said backing to the exterior of a golfer's garment at a location which is readily accessible and convenient for wiping a golf ball on said water absorbent material;

d. wherein said water absorbent material may be wetted with said bottom portion retaining water therein for keeping said water absorbent material damp, said bottom portion and said side walls preventing water from dripping onto a golfer; and e. a water absorbent cloth attached to said backing and extending below said bottom portion for wiping or drying a golf ball thereon.

22. The portable device of claim 21, wherein the water absorbent material is water absorbent sponge material.

23. A portable device for cleaning a golf ball comprising:

a. a waterproof backing having a front side, a back side, a top end and a bottom end, said bottom end extending outwardly and upwardly from said front side to form a bottom portion;

b. a water absorbent material retained at said front side of said backing, exposed outwardly therefrom, and extending into said bottom portion, said bottom portion including a pair of side walls on opposite ends of said bottom portion, said side walls extending upward to said top end of said backing and each including a lip forming an enclosure for removably retaining said water absorbent material therein;

c. means for removably attaching said backing to the exterior of a golfer's garment at a location which is readily accessible and convenient for wiping a golf ball on said water absorbent material;

d. wherein said water absorbent material may be wetted with said bottom portion retaining water therein for keeping said water absorbent material damp, said bottom portion and said side walls preventing water from dripping onto a golfer; and e. a water absorbent cloth attached to said backing and extending below said bottom portion for wiping or driving a golf ball thereon.

24. The portable device of claim 23, wherein the water absorbent material is a water absorbent sponge material.

* * * * *